US005543577A

United States Patent [19]

Zhu et al.

[11] Patent Number: 5,543,577

[45] Date of Patent: Aug. 6, 1996

[54] CONSTRUCTION OF MUSIC BOX

[75] Inventors: Yunde Zhu; Guohui Bai, both of Ningbo, China

[73] Assignee: Ningbo Dongfang Music Movements General Factory, Nigbo, China

[21] Appl. No.: 214,328

[22] Filed: Mar. 15, 1994

[30] Foreign Application Priority Data

Dec. 21, 1993 [CN] China ..... 93 2 35670.2

[51] Int. Cl.[6] ..... G10F 1/06

[52] U.S. Cl. ..... 84/95.2

[58] Field of Search ..... 84/94.1, 94.2, 84/95.1, 95.2

[56] References Cited

U.S. PATENT DOCUMENTS 4,401,006 8/1983 Sekiguchi ..... 84/95.1
4,458,573 7/1984 Isaka ..... 84/95.1
4,557,173 12/1985 Isaka ..... 84/95.1
4,570,524 2/1986 Isaka et al. ..... 84/95.1
4,890,528 1/1990 Kamijima ..... 84/95.2

*Primary Examiner*—Cassandra C. Spyrou
*Attorney, Agent, or Firm*—Pennie & Edmonds

[57] ABSTRACT

The comprehensive improvement of a music box employs a hood-styled structure (1) which is a connection between the spring case (6) and the speed regulating support (7). The perpendicular trailing brace of the hood-styled structure has eliminated the cantilever beam structure of the prior speed regulating support. A centrifugal periphery damping friction disk (21) is set below the top of said hood-styled structure (1). Three fixed connection holes on the lower edge of the hood-styled structure (1) are used to have the structure fixed on the frame (5). Compared with the prior art, the boss which may cause interference with the sound is now located in a reasonable position. The extended shaft of the music drum (3) is connected with the music drum with the spiral direction of the thread on the extended shaft being opposite to the rotary direction of the music drum. Thus, the reliability is increased, the quality of the sound is improved and the cost is reduced.

7 Claims, 3 Drawing Sheets

CONSTRUCTION OF MUSIC BOX

BACKGROUND OF THE INVENTION

The present invention relates to a music box, which is an improvement of the conventional technical solution for manufacturing music box.

As well known, the conventional music box comprises a frame, a spring case, a spring wound-up means, a gear train, a music drum (music cylinder), a vibrating member with comb-like seams, a speed regulating mechanism and the supports for each of the components.

In the prior art, the U.S. Pat. No. 4,458,573 has disclosed a technical solution and the exploded perspective view of which is shown in FIG. 5. This solution has several shortcomings as followed: 1) its spring case 3' and the speed regulating support 3A' are integrally molded with plastics; the overall spring case 3' includes an upper section and a lower section; the upper section (made of plastics) 3 and the lower section (made of aluminium-alloy) 27' are connected together through the holes 48', 49' (on upper section) being fired by the bosses 29', 30' (on lower section), thus, when assembled, there is a clearance on the circumferential wall where the upper and the lower sections are connected, and the window 50' formed on the circumferential wall is used for the spring (not shown) to have an end extended from inside the wall to outside, so that, the spring is capable of being firmly fixed on the wall of the spring case, however, when the spring is wound up tightly, the whole body of the spring case 3' will be deformed due to the force released by the spring; 2) since the speed regulating support 3A' and the spring case 3' are integral with each other, the deformation described above will cause directly the plane of the speed regulating support 3A' (cantilever beam structure) to be deflected, therefore, as the upper end **20*b'* of the speed regulating shaft 20' engages with the bearing hole 45' which is on the plane of the speed regulating support 3A', there is a great possibility for the speed regulating shaft 20' to deviate from the bearing hole 45' when the top of the speed regulating support 3A' deflects; 3) the boss 24' fitting with the hole 47' is located in such a position, which is adjacent to the front end of the vibrating member 6', and is just below the low-keys where they have their maximum amplitude, that once the music drum 2' rotates with high speed and plucks the keys violently, the low-keys and the boss 24' will interfere with each other, thus reducing the quality of the sound; 4) the damping weight part 38'**, similar with the conventional vane wheel structure, produces high noise in its operation; furthermore, such a structure is not capable of being connected easily by the brake means (not shown).

SUMMARY OF THE INVENTION

This invention has been made in view of the various shortcomings described above, and an object of the invention is to provide a music box which has the construction more reasonable than the prior one, in order to increase the reliability of the operation, improve the quality of the sound and reduce noises.

The object is achieved by providing:

a music box comprising a spring means, a gear train means, a music drum (music cylinder), a vibrating member, a frame and a speed regulating mechanism, wherein the spring case (6) of said spring means and the speed regulating support (7) of said speed regulating mechanism being a connection (1), one end of said connection (1) being the spring case (6) which has a complete circumferential wall whose lower edge being stepped projection (13), said stepped projection (13) being engaged with the notch (14) with circumferential wall on said frame, a perpendicularly trailing brace (8) being provided at the other end of said connection (1), several connection holes on the lower edge of said connection (1) being fitted with the bosses which are fixed an the frame (5), a centrifugal damping friction disk and a bearing hole for supporting and fixing the speed regulating shaft (20) being provided below the top of said connection.

The present invention will now be described in detail with reference to the accompanying drawings.

DETAILED DESCRIPTION OF THE PREFERRED EMBODIMENT

Figure 1:
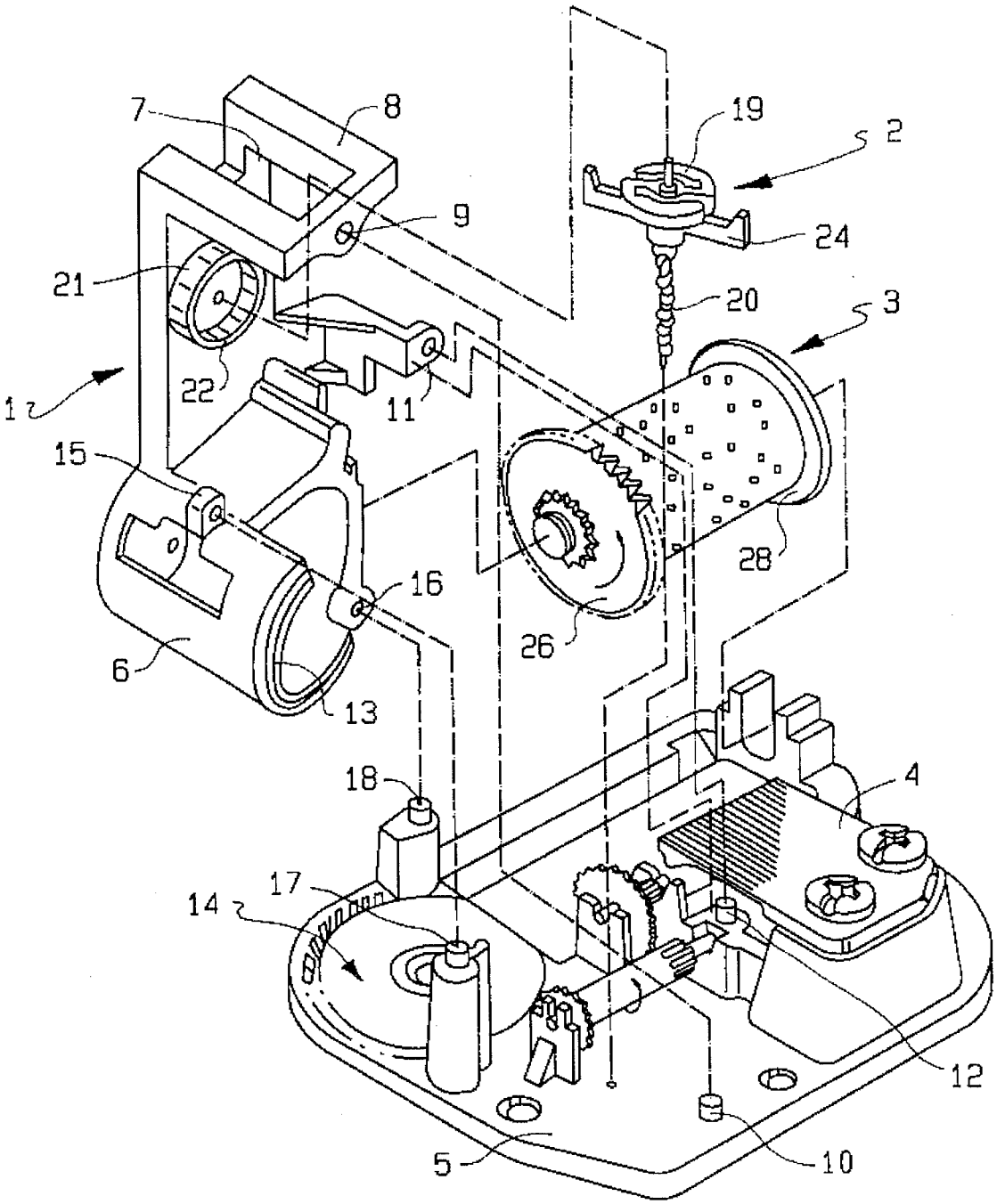
FIG. 1 is an exploded perspective view of the general construction of the present invention.
Figure 3:
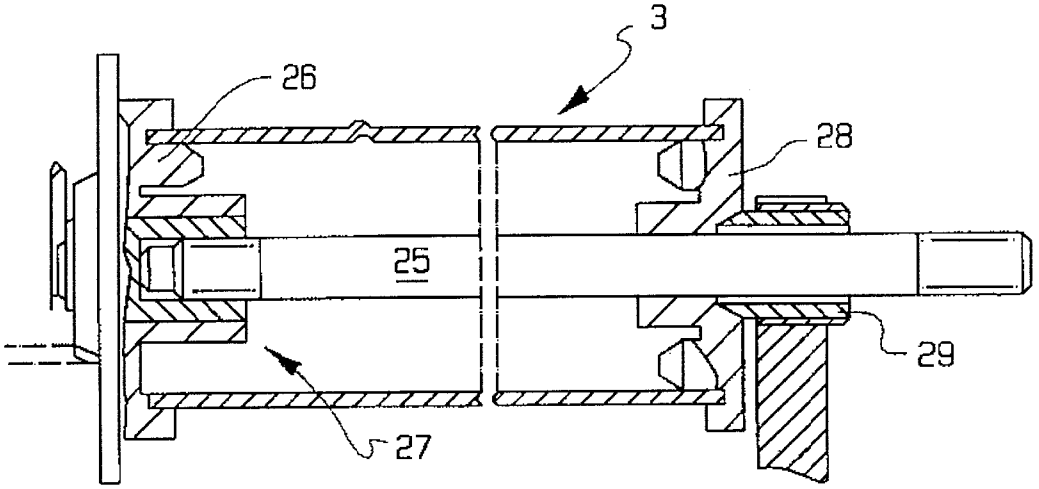
FIG. 3 is a cross-sectional view showing the assemblage of the music drum and the extended shaft.
Figure 4:
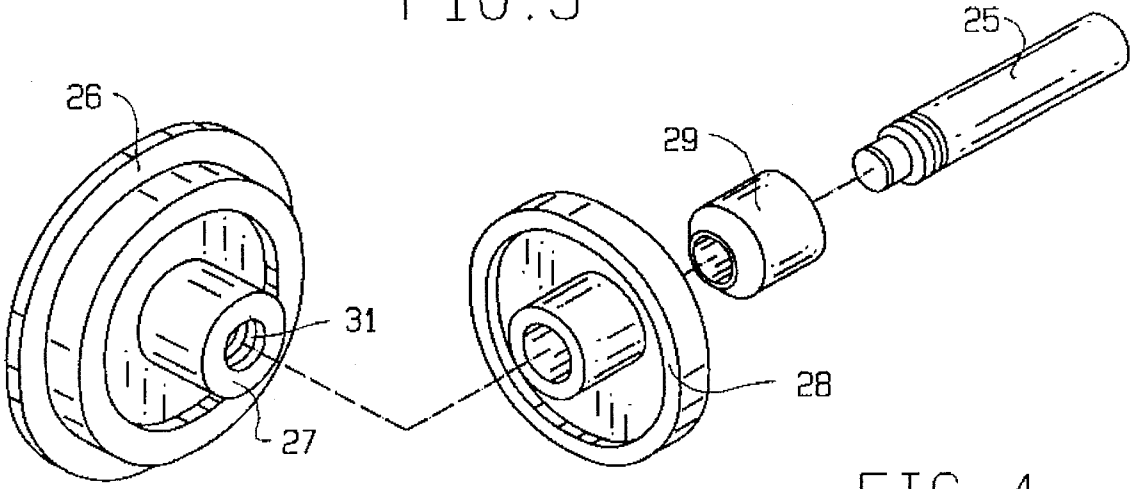
FIG. 4 is an exploded perspective view of the assembling of the extended shaft.
Figure 2:
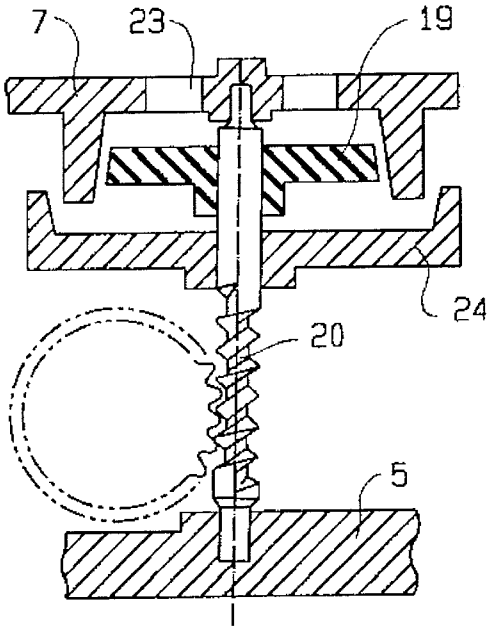
FIG. 2 is a cross-sectional view of the periphery damping friction device.

The overall construction of the present invention is shown in FIG. 1, which comprises a support 1, a speed regulating rotor 2, a music drum (music cylinder) 3, a vibrating member 4, a frame 5, a spring case 6, a spring wound-up means, an extended shaft 25, a gear train, etc. Support 1 is the connection for the speed regulating support 7 and the spring case 6.

Figure 5:
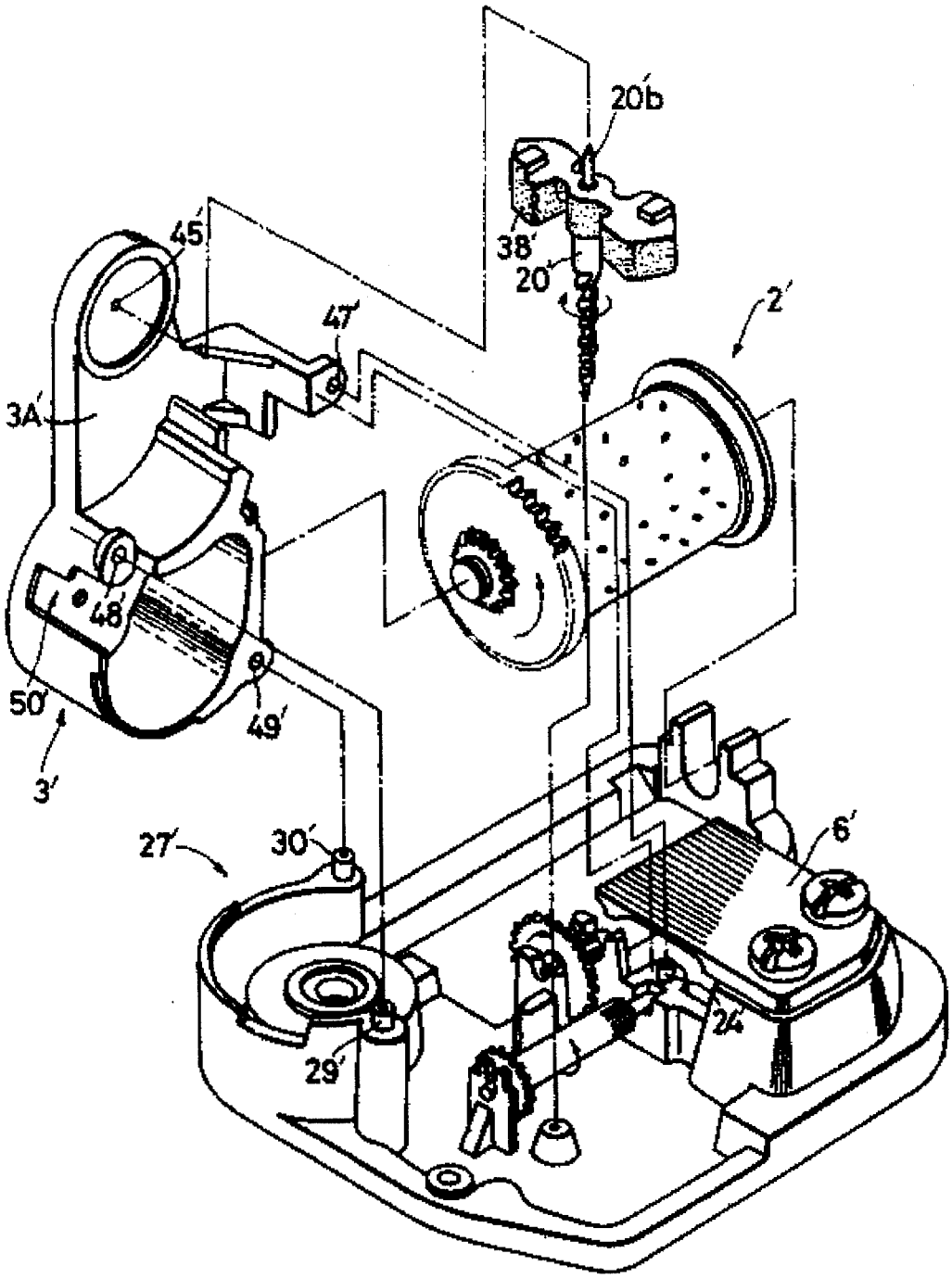
FIG. 5 Prior Art
FIG. 5 is an exploded perspective view of the general construction of conventional music box.

In order to compensate for the deficiency in mechanical strength of the connectional support 1, the present invention has made following improvements: 1) form a perpendicular brace 8 which trails to the ground (see FIG. 1) from the outer edge of the plane on which the cantilever beam of the speed regulating support 3A (see the part 3A of element 3 in FIG. 5) is situated on the prior support; fit hole 9 which has a lug and is incorporated on the bottom of the brace with the boss 10 which is on the frame so as to fix the support 1 firmly on the frame 5, and thus eliminate the cantilever structure on the top of the speed regulating support in the conventional construction.

2e) replace the two-section-styled circumferential wall of the former spring case which has a seam between the two sections with a one-section-styled wall; while the upper section of the former circumferential wall being molded with plastics (see 3 in FIG. 5), the lower section with aluminum-alloy (see 27 in FIG. 5), mold the present circumferential wall integrally with plastics, therefore, not only increase the mechanical strength of the spring case, but also reduce the consumption of aluminum and the cost; process the lower edge of said spring case 6 into a stepped projection 13 and fit it with the notch 14 on the circumferential wall of the frame 5 to consolidate the fixation of said spring case 6 with said frame 5, and thus, increase the rigidity of overall spring case; fit respectively the bosses 17, 18 on the frame with the two holes 15, 16 which have lugs and are on the side of the circumferential wall of the spring case 6 of support 1; the connected structure of support 1 has increased the mechanical strength of both the spring case 6 and the speed regulating support 7, prevented deformation from happening, and increased the reliability when the speed regulating shaft is installed on the support 1.

The hole 11 with lug of said support 1 fits with the boss 12 on the frame 5. In order to avoid the phenomenon that the low-keys and the boss interfere with each other, the hole 11 and the boss 12 are fitted relatively remotely from the front ends of the low-keys, therefore avoid the position where the keys have their maximum amplitude. Since the possibility of the keys in vibrating to interfere with the boss 12 is eliminated, the quality of the sound is improved.

The former top-damping friction of the speed regulating rotor has now been changed to the periphery-damping friction. The former centrifugal weight part, which is similar with a conventional vane wheel structure, and produces noises in operation, has now been replaced by a disk wheel structure (see 19 in FIG. 1). The centrifugal weight part of the disk wheel structure is made of flexible rubber material. A bearing hole with which the speed regulating shaft 20 is engaged, together with the centrifugal damping friction disk 21 is below the top of said support 1. It is preferable that said friction disk is a bowl-like periphery friction disk (or damping disk) 21, whose cavity holds said speed regulating shaft 20 and the centrifugal weight part 19. When the rotary speed of the speed regulating shaft is too high, the curve cantilever beam structure of the centrifugal weight part 19 will be thrown out in the direction of the radius. Once said weight part has contacted the inner surface 22 of the bowl-like damping disk 21 which is below the top of the support 1, friction will be produced and the rotary speed of the speed regulating shaft 20 will be pulled back to its normal state from a higher state. It is preferable that said inner surface 22 of the damping disk 21 is cone. The rotary speed when the weight part 19 and the inner surface 22 begin to contact with each other (speed when damping is produced) may be changed by adjusting the position where the weight part 19 is on the speed regulating shaft 20 in the direction of the shaft (namely to be close or to be far from the top of the speed regulating support 7). Push the centrifugal weight part 19 through the small hole 23 with a tool (not shown), and it will be moved downward. Pry said weight part 19 through the space between the inertia frame 24 and the centrifugal weight part 19 with a tool, and it will be moved upward easily.

In the present invention, an extended shaft 25 is inserted into the hollow cavity of the music drum, and they together form a drive means. The way they are connected is that: a projecting platform 27 which incorporates a screw 31 is formed on the plate 26 which is on the far end of the music drum when seeing in the direction that the extended shaft is inserted into the music drum: one end of said extended shaft which is connected with the plate 26 bas been processed with threads; the rotary direction of said threads is just opposite to that of the music drum 3; thus, the connection of the extended shaft 25 with the music drum 3 could only be tightened instead of be loosened in the operation of the music box. The connection of the extended shaft 25 with the plate 28 on the close end of the music drum and the bearing 29 part of the music drum is loose.

The advantages of the present invention are that the overall circumferential wall of the spring case is made of plastics, thus, the cost is reduced, the firmness and the rigidity of the spring case are all improved; since the speed regulating support 7 will not deflect or deform, the firmness and the reliability of the assembling of the speed regulating shaft are also greatly increased; the speed regulating mechanism produces no noise in operation, and the rotary speed when damping is produced can be adjusted; even if the keys are plucked violently, they and the fixed boss won't interfere with each other when the keys are vibrating. The present invention is a comprehensive improvement of the shortcomings of conventional music box (reference document), and it has made the connection and the fixation of the music box more reliable, also it has improved the quality of the sound.

What is claimed is:

1. A music box comprising:

a frame having a circumferential notch and a plurality of bosses;

a spring means for generating a rotational movement, said spring means comprising a spring case; said spring case having an integral circumferential wall including a lower edge, said lower edge being a stepped projection adapted to engage with said notch on said frame;

a music drum rotated by said spring means;

a vibrating member comprising a plurality of keys, said keys capable of being engaged with said music drum;

a speed regulating mechanism having a first end connected to said spring case to form a connection, a second end remote from said first end, a speed regulating support and a speed regulating shaft, said speed regulating support comprising a bearing hole for supporting said speed regulating shaft and a centrifugal damping friction disk, said speed regulating mechanism further comprising a brace trailing perpendicularly to said speed regulating support and being attached at said second end of said speed regulating mechanism, a plurality of connection holes being provided on said connection to fit with said bosses on said frame; and a gear train means for connecting said music drum to said speed regulating mechanism.

2. A music box according to claim 1 further comprising an extended shaft, said extended shaft having a threaded inserting end, said music drum having a hollow cavity, a far end and a close end, a first plate being arranged on said far end of said music drum, said first plate having an inner surface with a projecting platform inside said drum, said projecting platform having a central screw hole for engaging with said threaded inserting end of said extended shaft.

3. A music box according to claim 2, wherein said threads on said inserting end has a spiral direction, said music drum having a rotational direction, said spiral direction of said threads being opposite to said rotational direction of said music drum.

4. A music box according to claim 1, wherein said centrifugal damping friction disk is a periphery damping disk with a bowl-shaped cavity, said periphery damping disk holding a disk-shaped centrifugal weight part, said centrifugal weight part having a central portion being fixed on the speed regulating shaft and having two ends with a curve cantilever structure, said curve cantilever structure extending outside respectively from said central portion.

5. A music box according to claim 4 or 1, wherein said periphery damping friction disk has an inner surface, said inner surface of said periphery damping friction disk being a cone.

6. A music box according to claim 1, wherein said bosses are sized to fit with said holes to make a firm connection, said bosses being located below said vibrating member in a position relatively remote from said front ends of said low-keys.

7. A spring case support for a music box including a spring means, a gear train means, a music drum, a vibrating member, a frame and a speed regulating mechanism comprising:

a spring case having an integral circumferential wall for housing a spring, said circumferential wall having a lower edge, said lower edge being a stepped projection for engaging with a notch formed on said frame; and a speed regulating mechanism having a first end connected to said spring case to form a connection, a second end remote from said first end, a speed regulating support, and a speed regulating shaft being supported by said speed regulating support, said speed regulating mechanism further comprising a brace trailing perpendicularly to said speed regulating support and being attached at said second end of said speed regulating mechanism.

* * * * *